US010891826B2

(12) United States Patent
Jaffe

(10) Patent No.: US 10,891,826 B2
(45) Date of Patent: Jan. 12, 2021

(54) GAMING SYSTEM HAVING ASYNCHRONOUS MOTION OF SYMBOLS DETERMINING AWARD OUTCOMES

(71) Applicant: Bally Gaming, Inc., Las Vegas, NV (US)

(72) Inventor: Joel Roger Jaffe, Glenview, IL (US)

(73) Assignee: SG Gaming, Inc., Las Vegas, NV (US)

( * ) Notice: Subject to any disclaimer, the term of this patent is extended or adjusted under 35 U.S.C. 154(b) by 21 days.

(21) Appl. No.: 16/243,453

(22) Filed: Jan. 9, 2019

(65) Prior Publication Data

US 2019/0244481 A1 Aug. 8, 2019

Related U.S. Application Data

(60) Provisional application No. 62/626,252, filed on Feb. 5, 2018.

(51) Int. Cl.
*G07F 17/32* (2006.01)
*G07F 17/34* (2006.01)

(52) U.S. Cl.
CPC ..... *G07F 17/3267* (2013.01); *G07F 17/3213* (2013.01); *G07F 17/34* (2013.01)

(58) Field of Classification Search
None
See application file for complete search history.

(56) References Cited

U.S. PATENT DOCUMENTS 6,203,429 B1 3/2001 Demar et al.
6,315,660 B1 11/2001 DeMar et al.
6,358,147 B1 3/2002 Jaffe et al.
6,517,432 B1 2/2003 Jaffe
6,589,114 B2 7/2003 Rose
7,029,396 B2 4/2006 Jaffe et al.
7,077,745 B2 7/2006 Gomez et al.
7,112,136 B2 9/2006 Anderson et al.
7,147,559 B2 12/2006 Englman
7,195,559 B2 3/2007 Gilmore et al.
7,237,775 B2 7/2007 Thomas et al.
7,431,645 B2 10/2008 Han et al.
7,435,175 B2 10/2008 Fiden
7,452,271 B2 11/2008 DeMar et al.
7,455,585 B2 11/2008 Englman
7,618,315 B2 11/2009 Thomas et al.
(Continued)

FOREIGN PATENT DOCUMENTS

JP 2014069004 A * 4/2014 ..... G07F 17/34

*Primary Examiner* — James S. McClellan
*Assistant Examiner* — Peter J Iannuzzi

(57) ABSTRACT

A gaming system includes an input device, an electronic display device, and game-logic circuitry. In response to the input device detecting a physical item associated with monetary value that establishes a credit balance, the game-logic circuitry initiates a wagering game responsive to an input indicative of a wager drawn on the credit balance. The wagering game includes display of a gamescape that includes an award zone and a plurality of symbols moving around the gamescape on the display device. An award sequence is triggered when a predetermined threshold of the plurality of symbols are positioned completely inside the award zone. When the award sequence is triggered, the symbols inside the award zone stop moving and a corresponding award value is determined based on the symbols inside the award zone.

20 Claims, 8 Drawing Sheets

(56) References Cited

U.S. PATENT DOCUMENTS

| | | | | |
|---|---|---|---|---|
| 7,654,895 | B2 | 2/2010 | Pacey | |
| 7,704,141 | B1 | 4/2010 | Marks et al. | |
| 7,736,222 | B2 | 6/2010 | Casey et al. | |
| 7,749,073 | B2 | 7/2010 | Thomas et al. | |
| 7,780,519 | B2 | 8/2010 | Gomez et al. | |
| 8,105,145 | B2 | 1/2012 | Jaffe | |
| 8,287,358 | B2 | 10/2012 | Aoki | |
| 8,500,541 | B2 | 8/2013 | Veenker | |
| 8,616,956 | B2 | 12/2013 | Englman et al. | |
| 8,814,657 | B2 | 8/2014 | Englman et al. | |
| 8,834,258 | B2 * | 9/2014 | Gobe | G07F 17/34 273/138.1 |
| 8,888,582 | B2 | 11/2014 | Louie et al. | |
| 9,208,651 | B2 | 12/2015 | Jaffe | |
| 9,251,670 | B2 | 2/2016 | Aoki et al. | |
| 9,704,342 | B2 | 7/2017 | Aoki et al. | |
| 2004/0192431 | A1 * | 9/2004 | Singer | G07F 17/3244 463/20 |
| 2014/0066162 | A1 * | 3/2014 | Basallo | G07F 17/326 463/18 |
| 2014/0087821 | A1 * | 3/2014 | Zoltewicz | G07F 17/326 463/20 |
| 2019/0073860 | A1 * | 3/2019 | Reynolds | G07F 17/3213 |

* cited by examiner

GAMING SYSTEM HAVING ASYNCHRONOUS MOTION OF SYMBOLS DETERMINING AWARD OUTCOMES

CROSS-REFERENCE TO RELATED APPLICATIONS

This application claims the benefit of priority to U.S. Provisional Patent Application Ser. No. 62/626,252 filed on Feb. 5, 2018 and entitled "GAMING SYSTEM HAVING ASYNCHRONOUS MOTION OF SYMBOLS DETERMINING AWARD OUTCOMES," the contents of which are hereby incorporated by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2018, Bally Gaming, Inc.

FIELD OF THE INVENTION

The present invention relates generally to gaming systems, apparatus, and methods and, more particularly, to a gaming system using an outcome based on the alignment of objects during asynchronous motion in a gamescape generated on a display device of a gaming machine to determine a corresponding award.

BACKGROUND OF THE INVENTION

The gaming industry depends upon player participation. Players are generally "hopeful" players who either think they are lucky or at least think they can get lucky—for a relatively small investment to play a game, they can get a disproportionately large return. To create this feeling of luck, a gaming apparatus relies upon an internal or external random element generator to generate one or more random elements such as random numbers. The gaming apparatus determines a game outcome based, at least in part, on the one or more random elements.

A significant technical challenge is to improve the operation of gaming apparatus and games played thereon, including the manner in which they leverage the underlying random element generator, by making them yield a negative return on investment in the long run (via a high quantity and/or frequency of player/apparatus interactions) and yet random and volatile enough to make players feel they can get lucky and win in the short run. Striking the right balance between yield versus randomness and volatility to create a feeling of luck involves addressing many technical problems, some of which can be at odds with one another. This luck factor is what appeals to core players and encourages prolonged and frequent player participation.

Another significant technical challenge is to improve the operation of gaming apparatus and games played thereon by increasing processing speed and efficiency of usage of processing and/or memory resources. To make games more entertaining and exciting, they often offer the complexities of advanced graphics and special effects, multiple bonus features with different game formats, and multiple random outcome determinations per feature. The game formats may, for example, include picking games, reel spins, wheel spins, and other arcade-style play mechanics. Inefficiencies in processor execution of the game software can slow down play of the game and prevent a player from playing the game at their desired pace.

As the industry matures, the creativity and ingenuity required to improve such operation of gaming apparatus and games grows accordingly.

SUMMARY OF THE INVENTION

According to one aspect of the present invention, a gaming system comprises an input device, an electronic display device, and game-logic circuitry. The gaming system may be incorporated into a single, freestanding gaming machine. The input device detects a physical item associated with monetary value that establishes a credit balance. The game-logic circuitry initiates a wagering game in response to an input indicative of a wager drawn on the credit balance and directs the electronic display device to display a gamescape including an award zone and a plurality of symbols moving around the gamescape. An award sequence is triggered in response to a predetermined threshold of the plurality of symbols being completely inside the award zone wherein the predetermined threshold includes at least two moving symbols. An award value is determined associated with at least the symbols of the predetermined threshold triggering the award sequence and the award value is credited to a player.

According to one aspect of the present invention, a gaming system comprises an input device, an electronic display device, and game-logic circuitry. The gaming system may be incorporated into a single, freestanding gaming machine. The game-logic circuitry initiates a wagering game in response to an input indicative of a wager drawn on the credit balance and randomly determines a game outcome of the wagering game. In response to the game outcome including a bonus feature, the electronic display device is directed to display a plurality of symbols moving around a gamescape, wherein symbols of the plurality move into and out of a designated award zone within the gamescape. An award is triggered in response to at least two of the plurality of symbols being completely inside the award zone while at least one of the at least two symbols is in motion.

According to another aspect of the invention, a computer-implemented method in a gaming system is described. The gaming system includes an input device, an electronic display device, and game-logic circuitry. The method comprises the input device detecting a physical item associated with monetary value that establishes a credit balance. The game-logic circuitry initiates the wagering game in response to an input indicative of a wager drawn on the credit balance. The electronic display device displays a gamescape that includes a designated award zone and a plurality of game symbols. The game symbols move intermittently into and out of the designated award zone. Each game symbol is assigned a symbol value from a plurality of symbol values. The granting of an award is triggered by the game-logic circuitry in response to a predetermined threshold of the plurality of symbols being completely inside the award zone while at least one of predetermined threshold of symbols is moving. The award is based on the symbol values assigned to the predetermined threshold of symbols inside the award zone.

Additional aspects of the invention will be apparent to those of ordinary skill in the art in view of the detailed description of various embodiments, which is made with reference to the drawings, a brief description of which is provided below.

Figure 1:
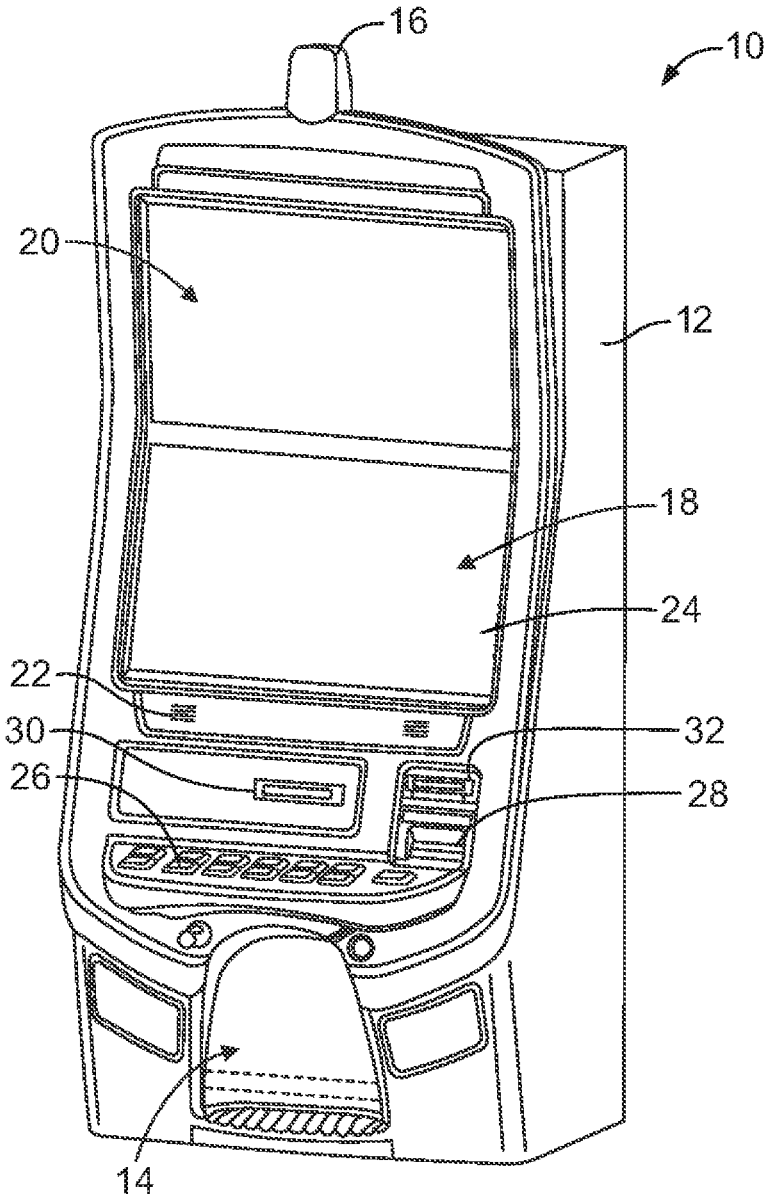
FIG. 1 is a perspective view of a free-standing gaming machine according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. Nos. 6,517,433, 8,057,303, and 8,226,459, which are incorporated herein by reference in their entireties.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. In order to deposit cash or credits onto the gaming machine 10, the value input devices are configured to detect a physical item associated with a monetary value that establishes a credit balance on a credit meter such as the "credits" meter 84 (see FIG. 3). The physical item may, for example, be currency bills, coins, tickets, vouchers, coupons, cards, and/or computer-readable storage mediums. The deposited cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. In response to a cashout input that initiates a payout from the credit balance on the "credits" meter 84 (see FIG. 3), the value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
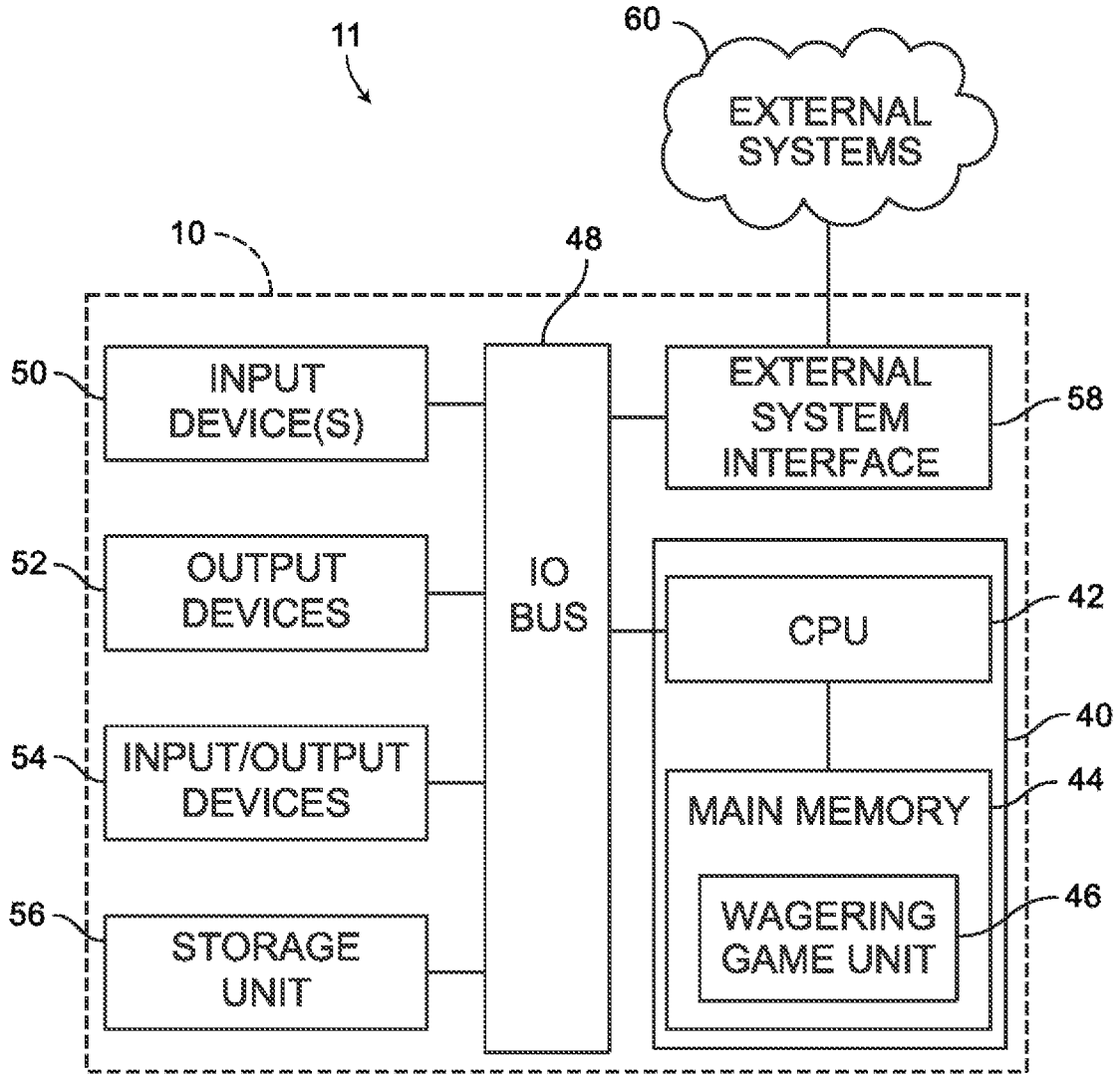
FIG. 2 is a schematic view of a gaming system according to an embodiment of the present invention.

Referring now to FIG. 2, there is shown a block diagram of the gaming-machine architecture as part of a gaming system 11 in one embodiment. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video black jack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compare it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human and is integral to operating the game.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
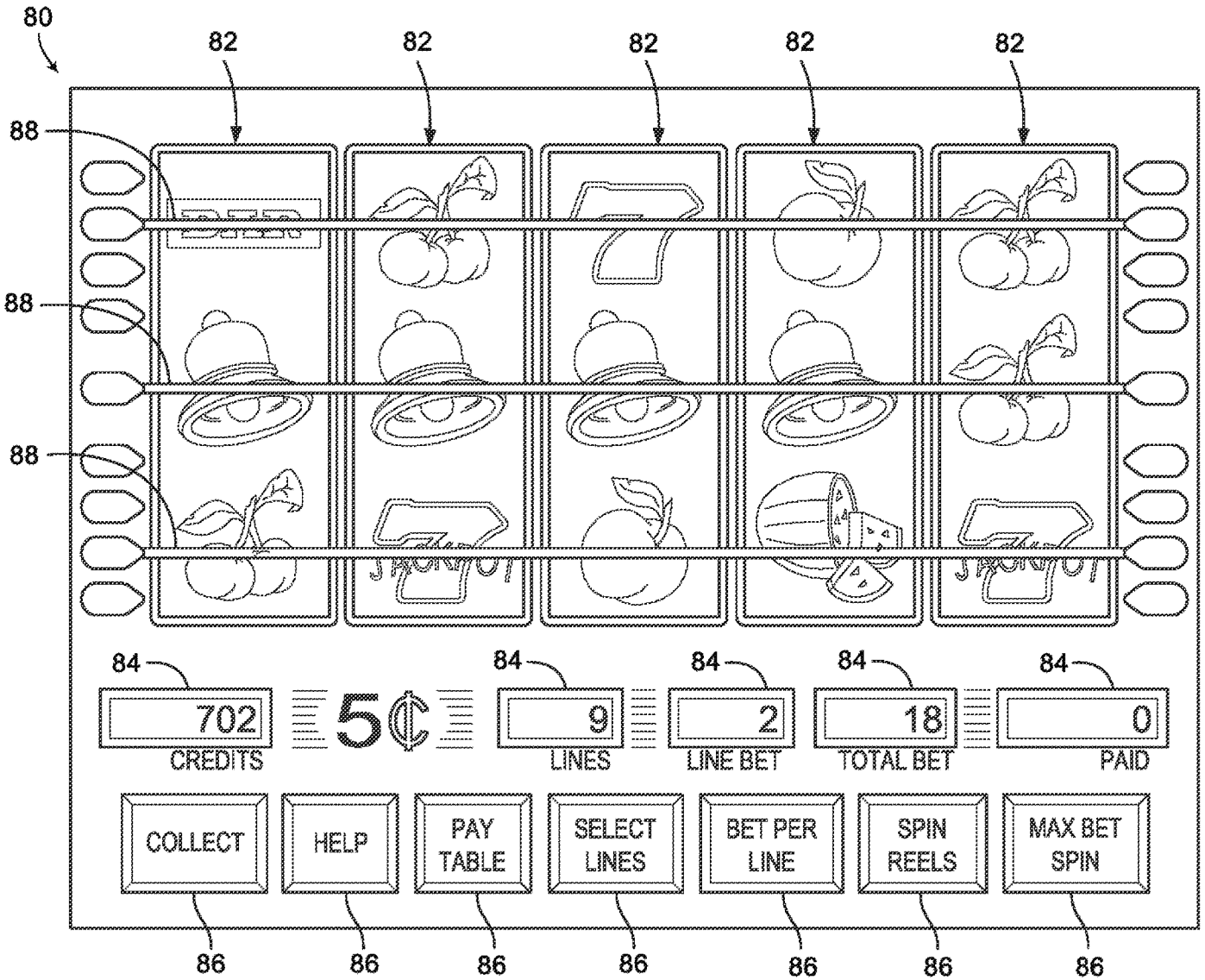
FIG. 3 is an image of an exemplary basic-game screen of a wagering game displayed on a gaming machine, according to an embodiment of the present invention.

Referring now to FIG. 3, there is illustrated an image of a basic-game screen 80 adapted to be displayed on the primary display 18 or the secondary display 20 in one embodiment. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 or the secondary display 20 to display the wagering game.

In response to receiving an input indicative of a wager covered by or deducted from the credit balance on the "credits" meter 84, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

Figure 4:
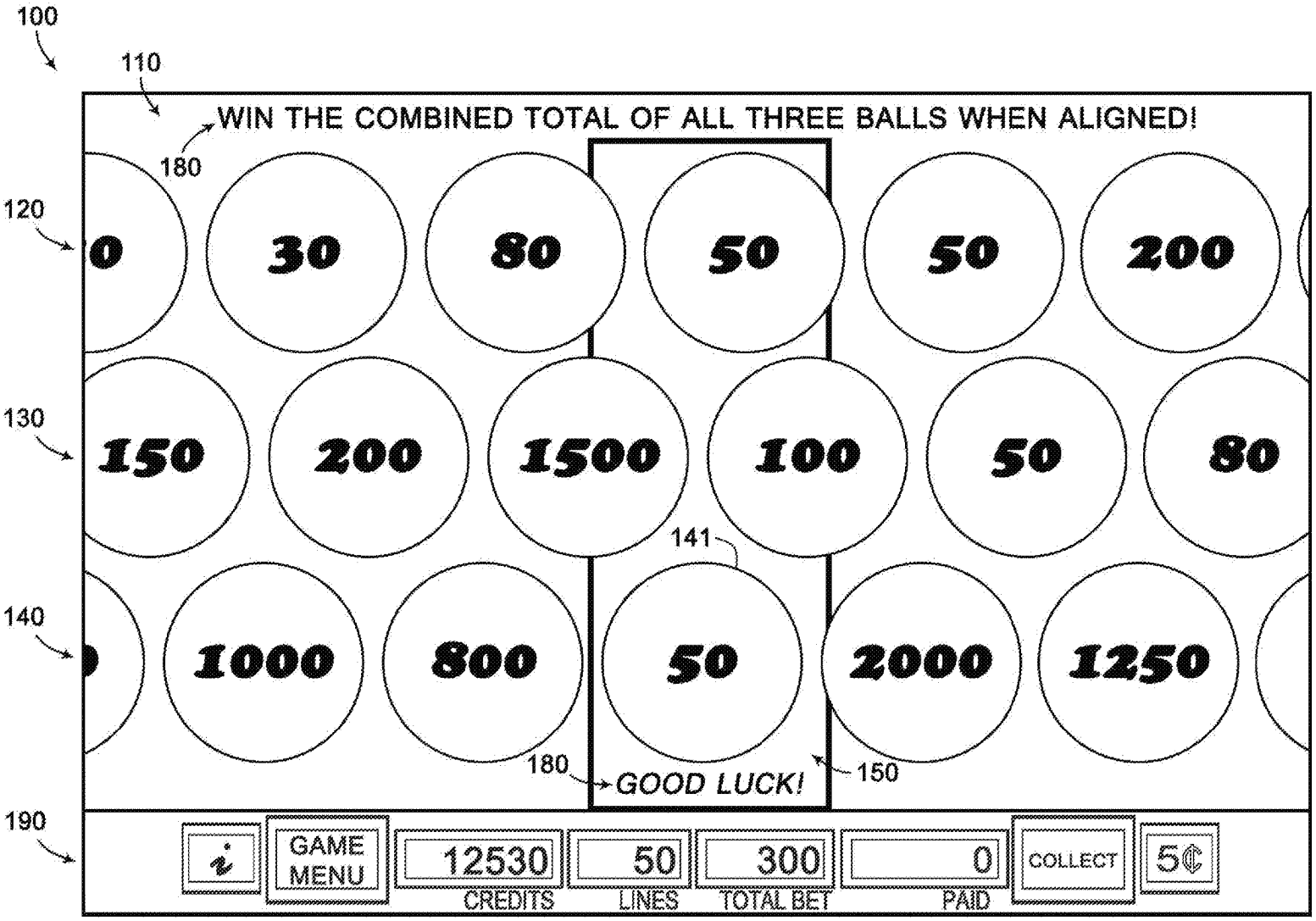
FIGS. 4-5 are images of exemplary game screens of a wagering game in progress as displayed on a gaming machine, according to an embodiment of the present invention.

Referring now to FIG. 4, there is illustrated an image of a game screen 100 adapted to be displayed on the primary display 18 or the secondary display 20 in one embodiment. The game screen 100 includes a gamescape 110 and a banner 190. The gamescape 110 includes a textual message 180. The message 180 and the banner 190 inform the player of gaming events and present available gaming information, and may include any additional configuration of information presentation, e.g. the meters 84 and/or buttons 86 as presented in FIG. 3. The message 180 may alternatively be iconic, graphical, textual, or a combination of these, and the banner 190 may be distributed about multiple regions of the game screen 100.

Figure 5:
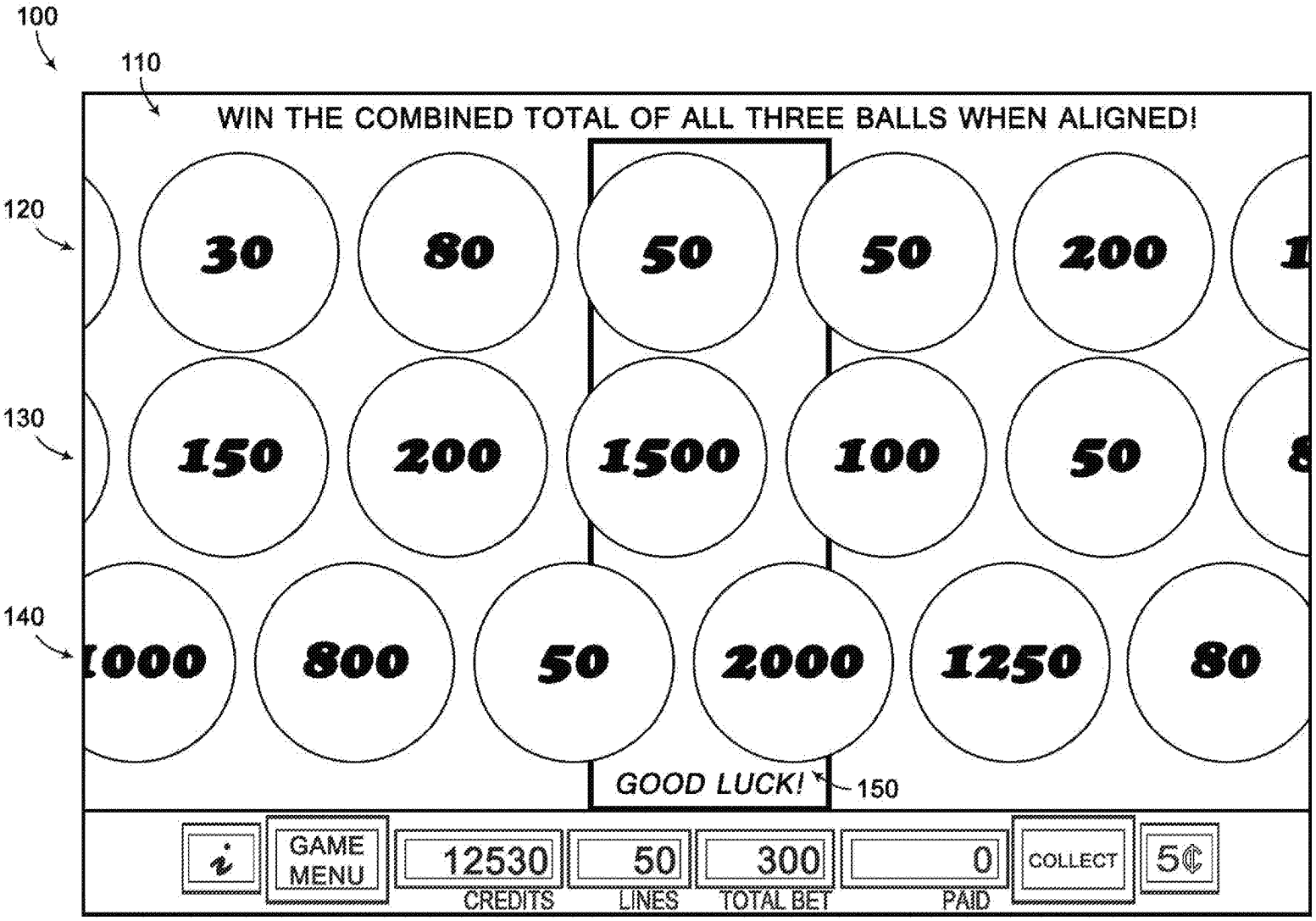
Figure 6:
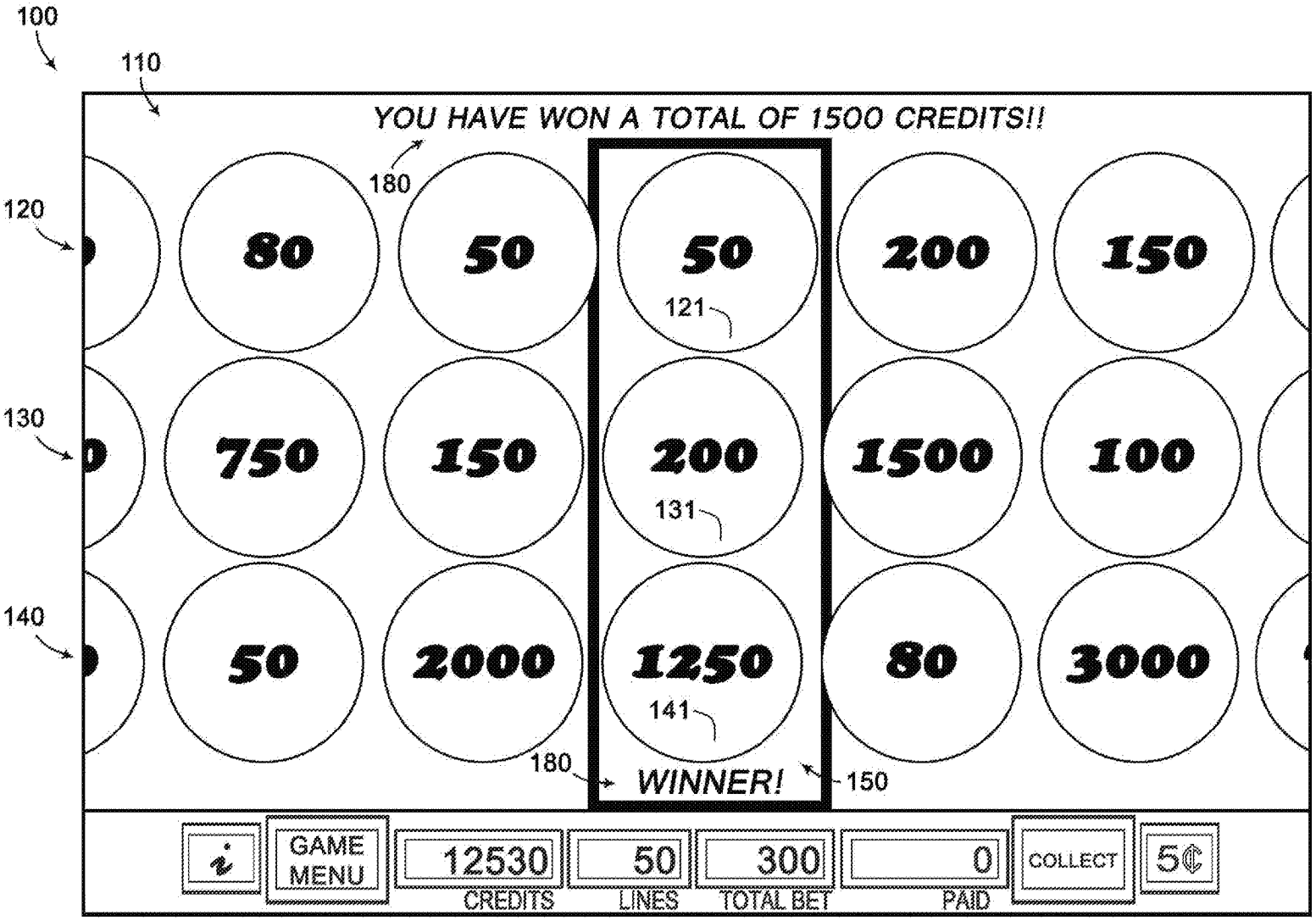
FIG. 6 is an image of an exemplary game screen of a wagering game showing a winning outcome as displayed on a gaming machine, according to an embodiment of the present invention.

A set of symbols are arranged in a respective set of symbol rows 120, 130, 140. The symbols of the rows 120, 130, 140 move about the gamescape 110. In FIGS. 4-6, the symbols in row 130 move from left-to-right and the symbols of rows 120, 140 move from right-to-left. That is, the symbols of the row 130 move around the gamescape 110 in an opposite direction compared to the motion of the symbols of the rows 120, 140. In one embodiment, the symbols of the rows 120, 130, 140 move at different speeds as compared to each other. Each row may additionally have variable movement (e.g., speed and/or direction) over time. The symbols of a row may stop moving for a period of time prior to resuming motion and may vary in speed at different times. In one embodiment, the spacing between adjacent symbols of a row is fixed, and in other embodiments, one or more symbols may move relative to other symbols in a row (i.e., the spacing between adjacent symbols may change while a row of symbols remain coherent).

The motion of symbols in a row including any individual symbols may exhibit a wide variety of movement patterns in different embodiments. The motion of the symbols in the same row 120, 130, 140 are generally similar, but may be (or become) variable when compared to other symbols of the same row or different rows. The symbols in the rows 120, 130, 140 may move consistently (uniformly and predictably) or erratically (e.g. unpredictably stopping/proceeding at irregular intervals). For example, the moving symbol rows 120, 130, 140 may include one or more symbols randomly stopping or slowing when in or near the award zone 150, or one or more symbols (or row of symbols) may stop in the award zone 150 until a winning condition occurs. The symbols of the one or more rows 120, 130, 140 may randomly stop and resume motion in unison or independently. A single row may have one or more constituent symbols stop and resume motion randomly (or predictably) from time-to-time. In one embodiment, the motion of the symbols of the gamescape 110 is totally random (e.g., the direction and/or rate of motion are randomly determined for each row 120, 130, 140). In another embodiment, the motion of the symbols are predetermined. Pseudo-random motions may also be used that do not depart from the overall spirit and scope for the invention.

In one embodiment, each of the symbols of the rows 120, 130, 140 display a designated symbol value that corresponds to a particular credit award value. For example, the symbol 141 has an indicated award value of fifty credits. The rows 120, 130, 140 may include one or more symbols indicating something other than a specific numerical award value (e.g., a multiplier that correspondingly increases the award value of other symbols, a merchandise prize indicator, entry into a sweepstakes, a jackpot or progressive jackpot indicator, etc.). Further, the rows 120, 130, 140 may include multiple symbols that may individually and/or collectively determine a corresponding award or award value (e.g., watermark symbols evaluated in combination with other symbols, specially marked symbols granting additional free spins, half a puzzle piece indicating a specific prize, etc.). Any type of symbol mapped to an award, value amount, and/or particular function is suitable for use as an award value.

The gamescape 110 includes an award zone 150 used to compare with the position of the moving symbols to indicate winning conditions and trigger an award sequence. As time passes, the symbols of the rows 120, 130, 140 move intermittently into and out of the designated award zone 150. In FIG. 4, only a single symbol 141 of the gamescape 110 is shown positioned completely inside the award zone 150. In another embodiment, more than one award zone 150 may be present in the gamescape 110. The size, shape, or alignment of the award zone 150 may change over time, e.g., temporarily expanding or changing orientation.

In one embodiment, an award sequence is triggered in response to a predetermined threshold of symbols being concurrently positioned completely inside the award zone 150. A predefined combination of symbols concurrently in the award zone 150 may also trigger a corresponding award sequence, e.g., two matching symbols or two matching halves of the same shape. In one embodiment, the predetermined threshold may require three symbols (e.g., a single symbol from each of the rows 120, 130, 140) to be completely inside in the award zone concurrently to trigger an award sequence.

In another embodiment, at least two moving symbols are required to be completely within the award zone 150 simultaneously to trigger an award sequence. In yet another embodiment, each pair of moving symbols that are concurrently inside the award zone 150 trigger a corresponding award sequence until three symbols are concurrently inside the award zone 150 triggering a conclusionary award sequence. As an award sequence is triggered, an award may be granted having a specific award value. The award value may be determined based on a sum of the associated values of the symbols triggering the award sequence, an associated value of the largest symbol, an associated value of the symbol having the largest associated value, a fixed value, etc.

Referring now to FIG. 5, there is illustrated an image of a game screen 100 showing the gamescape 110 after a short amount of time has passed compared with FIG. 4 as displayed on the primary display 18 or the secondary display 20 in one embodiment. None of the symbols of the rows 120, 130, 140 are completely inside the award zone 150, so no award sequence is currently triggered. In one embodiment, an award sequence is triggered when a predetermined threshold of moving symbols are concurrently positioned completely inside the award zone 150. During the feature, the symbols of rows 120, 130, 140 continue to move around the gamescape 110, intermittently into and out of the designated award zone 150.

The type of symbols, the motion (direction, speed, etc.) of the symbols, the shape of the gamescape itself, the shape, size, alignment, and/or number of one or more award zones, etc., are all variable and various embodiments do not impact the overall spirit and scope of the invention. For example, the award zone 150 may be oriented horizontally (instead of vertically), the gamescape 110 may be represented by a simulated two or three-dimensional space having a corresponding two or three-dimensional award zone, a circular (or spherical) award zone may be used with symbols in a simulated two or three-dimensional Brownian-motion chamber gamescape, etc. The size, orientation, and/or shape of the symbols in the gamescape 110 may also change (e.g., one or more moving symbols may expand, contract, deform, warp, rotate, etc.). In an embodiment, an alignment of a predetermined threshold of moving symbols in an award zone 150 triggers an award sequence to be performed. The triggering of an award sequence may explicitly include stopping the moving symbols (in the gamescape 110 and/or only inside the award zone 150) at a specific time. The presentation of symbol motion, the stopping of symbols, and the triggering of an award sequence may be achieved using random or pseudo-random determinations and/or a predetermined (scripted) motion of the symbols in the gamescape 110. The award zone may vary in size in response to an award sequence or randomly determined event. For example, an award sequence may cause the award zone to become larger, thus increasing the probability of the threshold number of symbols landing in the award zone.

The symbols of the rows 120, 130, 140 may continue to move in the gamescape 110 until an award sequence is triggered (or alternatively, until a time period has elapsed). In one embodiment, an award sequence causes an award to be granted determined from the sum of the associated values displayed/marked on each of the corresponding symbols completely in the award zone 150. When a predetermined threshold of symbols in the award zone 150 is met, a trigger award sequence includes stopping the movement of the symbols in the award zone 150 (and the remainder of the gamescape 110) and determining a corresponding award value to be credited to a player based upon the respective symbols. That is, an award value is associated with at least the symbols of the predetermined threshold triggering the award sequence.

Referring now to FIG. 6, there is illustrated an image of a game screen 100 showing the gamescape 110 displaying a predetermined threshold of symbols triggering an award sequence as displayed on the primary display 18 or the secondary display 20 in one embodiment.

In one embodiment, the award sequence is triggered and performed in response to the symbols 121, 131, 141 being completely inside the award zone 150. In this case, a predetermined threshold of the plurality of symbols completely inside the award zone triggers the award sequence while at least one of predetermined threshold of symbols is still moving. In some embodiments all the symbols of the gamescape 110 are simultaneously moving at the time the award sequence is triggered. A triggered award sequence may include stopping the predetermined threshold of symbols inside the award zone to display a winning condition. Thus, the player can observe, anticipate, and even predict a winning condition prior to an award sequence being triggered. This is distinguished from typical slot-type casino games and casino gaming machines where there is no simultaneous movement of multiple symbols that may be reasonably anticipated collectively.

Accordingly, the message 180 changes to report the outcome of the award sequence and report results of the award sequence to the player. In one embodiment, the award value is determined from a summation of the respective symbol values of the symbols in the award zone 150. An award sequence may impact one or more award sequences for other portions of a wagering game, for example, a bonus-game award sequence resulting in an award multiplier applied to a base-game feature award. The award sequence may include initiating one or more bonus games. An award value may also include award amounts related to symbols not currently in the award zone 150, e.g., a "WIN ALL" symbol awards the value of all symbols on the screen if it is part of the predetermined threshold.

In one embodiment, the movement of the symbols of the gamescape 110 will continue until a winning condition is met and a corresponding award sequence is triggered. In another embodiment, an award sequence is triggered only if the predetermined threshold of symbols are concurrently positioned inside the award zone 150 during a set duration of time of symbol movement. In another embodiment, a duration of time is set and a separate award sequence is triggered each time a predetermined threshold of symbols are concurrently positioned inside the award zone 150. Alternatively, a single award sequence may be performed that reflects the results of plural predetermined threshold symbol combinations inside the award zone 150 occurring during the time period. It is also possible that the gamescape 110 is displayed for a predetermined period of time and display of the gamescape 110 is then terminated without triggering an award sequence (no award is granted). In another embodiment, the time elapses and the next symbol to completely enter the award zone 150 triggers an award sequence. In another embodiment, after a timer has expired, a new predetermined threshold is set (e.g., another timer using the new predetermined threshold begins). In yet another embodiment, an award sequence may extend the predetermined period of time.

One or more of the above described features may be performed to determine one or more random game outcomes and awards for a wagering game. The wagering game may include base-game and/or bonus-game features that incorporate operations similar to the above. The awards and/or gaming event outcomes may be determined randomly or involve player skill. A gaming outcome may be presented to appear random to the player, but be predetermined (and presented in a scripted fashion). Further, one or more player-input elements (skill-based or not) may be used to determine one or more aspects of the outcome, e.g., determining the duration for the movement, altering the position or motion of one or more symbols or rows 120, 130, 140 of the gamescape, determining placement or orientation of the award zone 150, etc., that may or may not alter the presented outcome for the wagering game.

Figure 7:
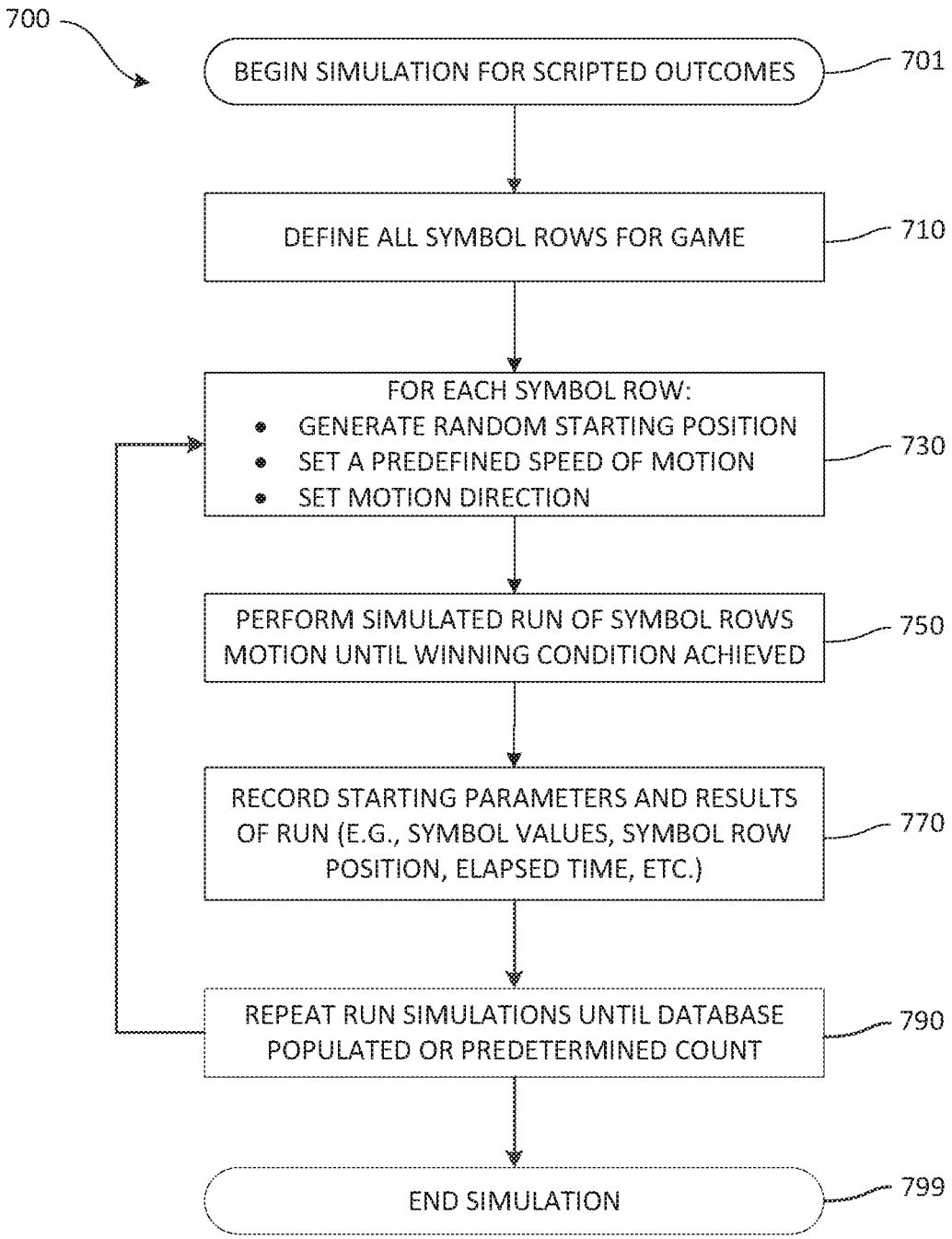
FIG. 7 is a flowchart for a data processing method for simulating scripted gaming outcomes corresponding to instructions executed by a controller in accord with at least some aspects of the disclosed concepts.

Referring to FIG. 7, a data processing method 700 is described for simulating wagering game outcomes and presentations (e.g., a predetermined threshold of symbols concurrently positioned inside an award zone) in one embodiment. A database is used to store gaming outcomes and/or presentation parameters for later use during scripting presentation of gaming events and triggering award sequences of a particular type. The database, once populated with a sufficiently large number of simulated runs and corresponding results, may also be used to determine an overall return-to-player operational probability for the performing device, generate reports for additional game development, and/or establish a library of outcomes or outcome types that may be used to present enhanced anticipatory gaming events with a known and predictable award amount.

In step 701, the simulation process begins. A database is allocated to store the information derived from the running of each simulated run. The database may be present on the computing device performing the simulations or be remotely located and provided data via networking communicative techniques well known in the art. The database may include a set of initial parameters for the simulations or the run as a whole (e.g., a randomization seed, initial conditions, operational constraints, etc.).

In step 710, the format and operational parameters for the symbol rows 120, 130, 140 are specified for use by the simulator. For example, information that relates directly to the presentation of the symbols during the feature is provided or determined, and stored. Information may include the number of symbols available in each row, the width or size of each symbol, the spacing between symbols, symbol movement patterns, etc. Specific award amounts associated for each symbol element of each row 120, 130, 140 may also be explicitly specified in order to determine a final award for the simulated run. In some embodiments, the simulations may result in a collection of randomized simulated run results that may be categorized and stored in the database for access and randomized lookup (e.g., for usage in a scripted presentation during a wagering game). The resulting database may include a large number of specific sets of wagering game outcomes that may be accessed using predetermined values or one or more random numbers. An expected value (or return-to-player) for a casino machine may be determinable analyzing a database specifying award amounts for each outcome such that over long periods of time the performance of the gaming machine can be reasonably predicted (e.g., the casino edge). Further, the database may be able to retrieve a set of symbol motion sequences specified to operate within a specified amount of time (e.g., 5.5 seconds) in order to provide initial conditions to script the presentation of one or more features during a confined time period.

In step 730, a set of information for each symbol row is generated, either through express assignment, random, or pseudo-random determinations. Information may include the starting position for each row or symbol for the feature, the initial speed of the motion for the symbols of the row, the motion direction for the row, data associated with one or more symbol elements, parameters or timing information for row or symbol motion, etc. The information is used to perform one or more simulated runs of the feature using the determined initial conditions so that at least one final outcome (i.e., results and parameters gathered during the run) may be generated and recorded.

In step 750, the gamescape 110 is simulated in accordance with the specified parameters and initial constraints specified for the run. In one embodiment, the motion for the symbol elements of the symbol rows 120, 130, 140 are determined. The simulation continues until a winning condition is achieved (i.e., an award sequence is triggered, as previously detailed). In other embodiments, the simulated run may be terminated after a specific amount of time or calculation cycles (e.g., when no winning condition is achieved in a specific duration). Selectively, results may be filtered out and omitted from the database, e.g., ambiguous outcomes, results falling outside a predetermined range, unexpected or improper outcomes, etc.

In step 770, the parameters (and results) of the run (that may include the award amount, row positions, elapsed time, number of stops/restarts, etc.) are recorded in the database. The database may store this information in a variety of ways, including use of relations/tables that may be queried using values of one or more entries. The information stored in the database may be uniformly tied to a common set of initial conditions or require initial conditions to be stored with the simulation results. The specifics of the structure, format, and nature of the database does not directly impact the spirit and scope of the invention.

In step 790, a determination is made as to whether any additional simulated runs are being performed. For example, a counter may be used to count completed simulations and stored database entries so a fixed number of simulated runs populate the database upon completion. In other cases, simulation runs may continue as long as room exists in the database to store the generated information. In any case, when an additional simulated run is to be performed, flow returns to step 730 where new initial conditions are specified for the new simulated run. The process of generating initial conditions, running the simulated run, and recording the results of the run are repeated until no additional runs are to be performed.

In step 799, the process of method 700 concludes. In one embodiment, the resulting database stores the parameters and simulated outcomes (predetermined threshold of symbols concurrently positioned inside an award zone) for a sufficiently large number of runs for a feature. Once completed, the method 700 may finalize or otherwise authenticate the database as a whole to ensure no tampering or errors with particular entries of the database occur during copying or transfer.

Once finalized, the database is populated with data and becomes available to be used to analyze overall operation of the wagering game machine (e.g., determine a payout probability for the machine) and/or to conduct one or more features (e.g., conforming to the prior description of FIGS. 4-6). In one embodiment, when a game is initiated as a bonus feature of a wagering game, the following process may be used to generate and display presentation of an outcome and triggered award sequence. In different embodiments, a random number or a specific winning condition for the feature may be specified to access associated information in the database.

Figure 8:
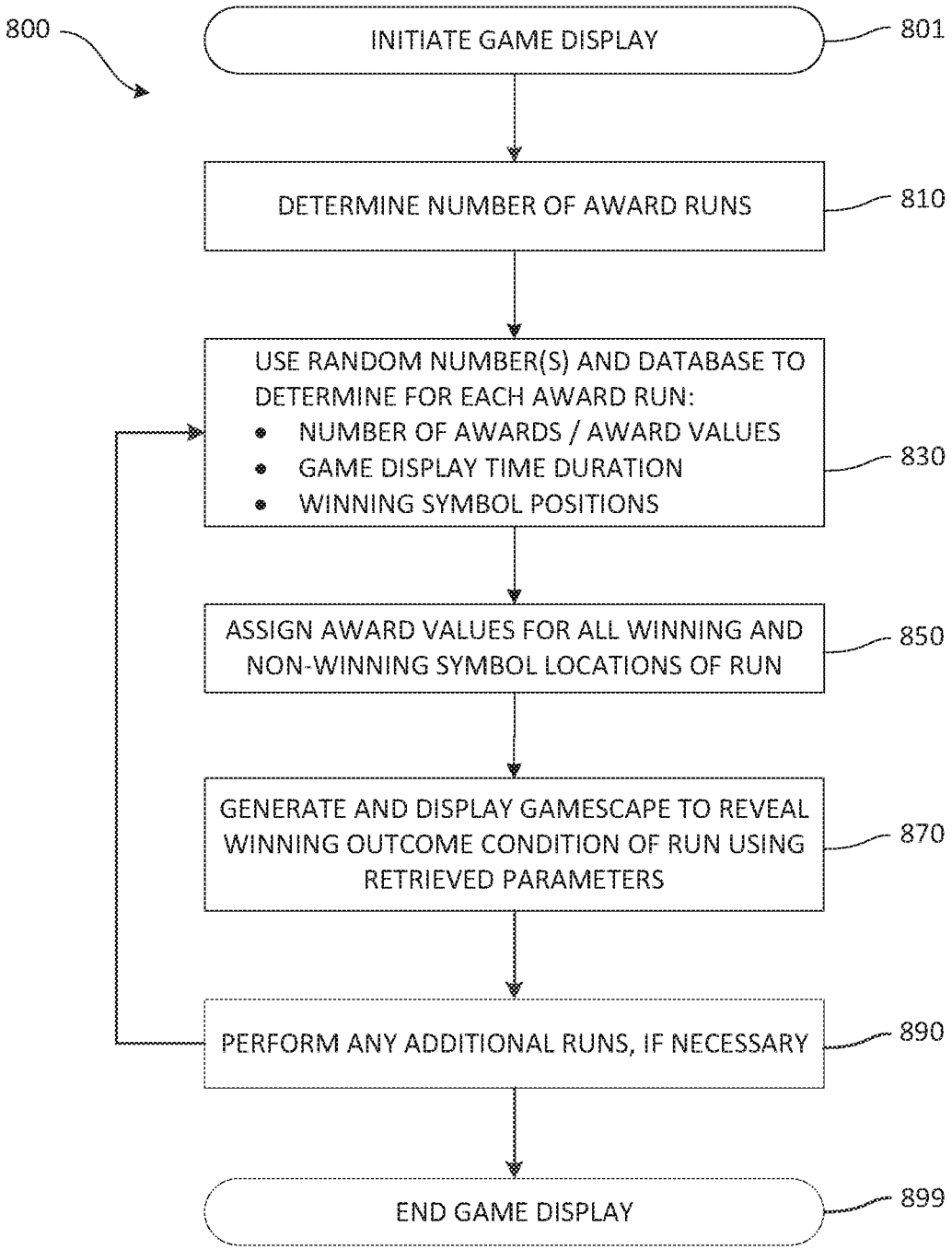
FIG. 8 is a flowchart for a data processing method for initiating and performing gaming instances corresponding to instructions executed by a controller in accord with at least some aspects of the disclosed concepts.

Referring to FIG. 8, a data processing method 800 is detailed for generating gaming outcomes and/or scripting the presentation of triggering award sequences (e.g., as previously described in FIGS. 4-6 in one embodiment). Particularly, the method 800 may be used to provide a "randomized" version of an outcome including a presentation that triggers one or more award sequences resulting in a particular award amount gaming outcome. The method 800 relies upon one or more databases, such as a database generated using process 700 detailed in FIG. 7. An accessed database must include a data set that can provide, in response to a random number and a set of initial constraints, parameters and information that enable reproduction of one or more simulated runs such as those described in FIG. 7.

In step 801, the process 800 is initialized and begins. The process 800 may be initiated by a parent process requesting presentation of one or more portions of a wagering game having a provided parameters. One or more parameters may be provided as an operational constraint (e.g., an amount of time, an award amount, random number generated by a RNG, etc.), and additional parameters may be determined as required for completion of the presentation for the wagering game.

In step 810, a specific number of award sequences is determined that will be used to collectively generate an outcome for the wagering game in one embodiment. Each award sequence may be independent from all the others, or be linked in one or more ways. For example, multiple award sequences may be used to provide an outcome with a result equating to performing a single award sequence with a higher award value. Thus, there is some flexibility in the way that a specific award amount may be presented to a player to enhance the winning experience and maximize anticipation and excitement. In one embodiment, a random determination is made to isolate the number of award sequences and associated award amounts that may be presented during the reveal of the gaming outcome.

In step 830, required data values are provided for generating the presentation for the displayed feature, for example, a set of parameters used to generate and control display details of the gamescape 110. One or more random numbers may be provided and/or generated and used to access information stored in the database to retrieve and derive parameters necessary for generation and presentation of the feature run. For example, an award value for an outcome of the feature may be provided as a fixed credit amount. In response, the system determines a set of award values (e.g., by the game-logic circuitry 40) that includes an award value for each of the predetermined threshold of the plurality of symbols stopping completely inside the award zone that will trigger the award sequence. The parameters may also include the initial positions of the symbols within each row, symbol movement templates for the symbols and/or rows, specific outcome specifications, etc. Other parameters may require additional database lookups for random determination of award amounts, specified winning symbol locations/values, duration of presentation constraints, row or symbol element motion constraints/directives, etc. In one embodiment, the database provides a set of initial starting positions for each symbol and the details of motion for each of the rows in response to selection of a random number. The retrieved information will be used by game-logic circuitry 40 to generate and display the presentation of the feature and the gamescape 110 resulting in a gaming outcome (e.g., as specified by a random number and a specified credit award amount).

In one embodiment, a movement scenario is selected from the database based upon the random number specifying an award sequence triggered by three symbols 121, 131, 141 positioned completely inside the award zone 150 (FIG. 6) conducted in a specified amount of time. Thus, the location of the three "winning" symbols are known (i.e., the predetermined threshold of the plurality of symbols completely inside the award zone at award sequence trigger), but there may not be an associated award value for any of the symbols used in the gamescape 110. The award values for the symbols may be based upon the size of the initial wager and the random number determining the feature outcome. If a total award is already determined, a set of symbol values can be derived and assigned to the three winning symbols triggering the award sequence (and all others) for the presentation.

In step 850, the determined award values for the winning symbols are assigned to the winning symbols. Additionally, associated award values for the non-winning symbols are also populated for the presentation. In the event that additional information needs to be derived (e.g., starting positions for the row symbol elements, timing constraints, row speed modifications, scheduled pauses, etc.), the additional information is used to generate the details of the display for the gamescape 110 during execution of the feature run. Additional calculations may occur to ensure the system can accurately present the feature run and gamescape 110 as intended.

In step 870, the gamescape 110 is generated and displayed, and the feature run is performed in accordance with the provided, derived, and accessed information assembled from the game-logic circuitry 40, including the one or more databases being used. The feature is conducted until an award sequence is triggered as part of the presentation to the player. That is, the feature run is conducted in accordance with the provided information and operational constraints in order to present the gaming outcome having the specified resulting award. Other steps that may occur at this stage include conclusion of the feature run, an increase of an award meter 84, the addition of animation, accompanying audio, or other generated presentations (e.g., sub-outcomes or triggers for additional features), etc. In short, the gaming outcome (including the lead-up to the award sequence and the reporting of the granted award) is presented to the player for the feature run.

In step 890, a determination is made as to whether any additional feature runs are necessary for the feature or the feature is due to conclude. If additional award runs are required, flow returns to step 830 to repeat the process of assembling information for generating the gamescape, presenting the gamescape and outcome to the player, and again determining whether additional runs are required. In the event no additional runs are required, the method 800 ends in step 899.

The present invention improves the overall technological operation of a wagering game machine and associated wagering game, minimally by requiring only a single random number call (e.g., using an RNG and/or a database as discussed prior) to perform a bonus game feature including multiple opportunities for a player to win. Prior art slot machines and video slot machines are required by various jurisdictional statutes to write and store random number data in a non-volatile (off-board) memory module (e.g., one or more dedicated components of memory 44) each time a RNG call is performed. Every RNG call requires extra processing time and increased power consumption for CPU and memory components (e.g., the game-logic circuitry 40). Often, an RNG call is made for each individual reel of a slot machine for each gaming instance. As large numbers of RNG calls and recordation becomes required, a significant burden of processing and writing is incurred for the computing device. The invention may significantly improve the overall operation and performance of a wagering game machine via use of a single random number for generating multiple gaming outcome instances (e.g., 30-50 "free spins" during a bonus round in accordance with FIGS. 7-8). The utilization of a prepopulated database scripted outcome database and a random number via a single RNG call, an unlimited number of specified and displayed outcomes may be performed.

FIGS. 7-8, described by way of example above, represents a set of computerized method processes corresponding to at least some instructions stored and executed by the game-logic circuitry 40 in FIG. 2 to perform aspects of the above described functions associated with the disclosed concepts. The operations detailed in FIGS. 7-8 are not to be specifically limited to the recited detail specifics. A variety of modifications and alternative embodiments may be used without departing from the overall spirit and scope of the invention. While FIGS. 7-8 detail a set of methods for database generation, usage, and access to generate wagering game outcome presentations, the invention is not to be limited to this particular type of operation, nor to any requirement that this type of operation is necessary.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A gaming system comprising:

an input device configured to detect a physical item associated with monetary value that establishes a credit balance;

an electronic display device; and game-logic circuitry configured to:

initiate a wagering game responsive to an input indicative of a wager drawn on the credit balance;

direct the electronic display device to display a gamescape including an award zone and a plurality of symbols moving around the gamescape, and trigger an award sequence in response to a predetermined threshold of the plurality of symbols being completely inside the award zone at the same time, the predetermined threshold including at least two moving symbols, the award sequence including directing the electronic display device to display stopping the movement of the at least two symbols and determining an award value to be credited to a player, the award value being associated with at least the symbols of the triggering predetermined threshold.

2. The gaming system of claim 1, wherein symbols of the plurality have designated symbol values and wherein the award value is based on the respective symbol values of the symbols of the triggering predetermined threshold.

3. The gaming system of claim 1, wherein moving includes one or more symbols of the plurality randomly stopping or slowing inside the award zone.

4. The gaming system of claim 1, wherein the award is the summation of the respective symbol values assigned to the symbols of the triggering predetermined threshold.

5. The gaming system of claim 1, wherein the award value and the corresponding motion of the plurality of symbols are determined prior to the award sequence trigger.

6. The gaming system of claim 1, wherein the at least two moving symbols move around the gamescape in opposite directions.

7. The gaming system of claim 1, wherein the award sequence is triggered in a bonus feature of the wagering game.

8. A gaming system comprising:

an input device configured to detect a physical item associated with monetary value that establishes a credit balance;

an electronic display device;

game-logic circuitry configured to:

initiate a wagering game responsive to an input indicative of a wager drawn on the credit balance, randomly determine a game outcome of the wagering game, in response to the game outcome including a bonus feature, direct the electronic display device to display a plurality of symbols moving around a gamescape, wherein symbols of the plurality move into and out of a designated award zone within the gamescape, and trigger an award in response to at least two of the plurality of symbols being completely inside the award zone at the same time while at least one of the at least two symbols is in motion.

9. The gaming system of claim 8, wherein moving includes one or more symbols of the plurality moving at different speeds.

10. The gaming system of claim 8, wherein moving includes one or more symbols randomly stopping and starting.

11. The gaming system of claim 8, wherein the award and the corresponding motion of the plurality of symbols are determined prior to the trigger of the award.

12. The gaming system of claim 8, wherein at least two of the plurality of symbols move around the gamescape in different directions.

13. A computer-implemented method of conducting a wagering game on a gaming system, the gaming system including an input device configured to detect a physical item associated with monetary value that establishes a credit balance, an electronic display device, and game-logic circuitry, the method comprising:

detecting, by the input device, a physical item associated with monetary value that establishes a credit balance;

initiating, via the game-logic circuitry, the wagering game in response to an input indicative of a wager drawn on the credit balance;

displaying, on the electronic display device, a gamescape including a designated award zone and a plurality of game symbols moving intermittently into and out of the designated award zone, each game symbol being assigned a symbol value from a plurality of symbol values;

trigger an award, via the game-logic circuitry, in response to a predetermined threshold of the plurality of symbols being completely inside the award at the same time while at least one of predetermined threshold of symbols is moving, the award being based on the symbol values assigned to the predetermined threshold of symbols.

14. The computer-implemented method of claim 13, wherein the gamescape is displayed for a predetermined period of time, and wherein display of the gamescape is terminated in response to the predetermined period of time elapsing without triggering an award.

15. The computer-implemented method of claim 13, wherein triggering an award includes stopping the predetermined threshold of symbols inside the award zone.

16. The computer-implemented method of claim 13, wherein triggering an award includes stopping the plurality of symbols.

17. The computer-implemented method of claim 13, wherein the award is the summation of the symbol values of the predetermined threshold of the plurality of symbols.

18. The computer-implemented method of claim 13, wherein moving includes one or more symbols of the plurality randomly stopping or slowing inside the award zone.

19. The computer-implemented method of claim 13, wherein the award, the award trigger, and the corresponding motion of the plurality of symbols are determined prior to the award sequence trigger.

20. The computer-implemented method of claim 13, wherein at least two of the plurality of symbols move into the designated award zone in opposite directions.

* * * * *